US007975400B2

(12) United States Patent
Dittmer et al.

(10) Patent No.: US 7,975,400 B2
(45) Date of Patent: Jul. 12, 2011

(54) DEVICE FOR DETERMINING THE CONDUCTANCE OF LAUNDRY, DRYERS AND METHOD FOR PREVENTING DEPOSITS ON ELECTRODES

(75) Inventors: Lothar Dittmer, Berlin (DE); Harald Moschuetz, Grossbeeren (DE); Thomas Nawrot, Berlin (DE); Andreas Ziemann, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 541 days.

(21) Appl. No.: 10/539,453

(22) PCT Filed: Dec. 20, 2003

(86) PCT No.: PCT/EP03/14177

§ 371 (c)(1), (2), (4) Date: May 1, 2006

(87) PCT Pub. No.: WO2004/059072

PCT Pub. Date: Jul. 15, 2004

(65) Prior Publication Data

US 2006/0248746 A1 Nov. 9, 2006

(30) Foreign Application Priority Data

Dec. 20, 2002 (DE) ..... 102 60 149

(51) Int. Cl.
*F26B 19/00* (2006.01)

(52) U.S. Cl. ..... 34/528; 34/535; 34/606; 34/549; 34/543; 34/555; 73/75; 204/560; 313/25; 392/269; 219/501; 219/553; 8/159; 8/138

(58) Field of Classification Search ..... 34/528, 34/606, 549, 543, 555; 73/75; 204/560; 313/25; 392/269; 219/501, 553; 8/159, 8/138

See application file for complete search history.

(56) References Cited

U.S. PATENT DOCUMENTS 1,413,877 A * 4/1922 Schmidt ..... 95/66
2,109,130 A * 2/1938 Fisher ..... 204/560
(Continued)

FOREIGN PATENT DOCUMENTS

DE 29 01 974 7/1980
(Continued)

OTHER PUBLICATIONS

International Search Report for PCT/EP2003/014177.

*Primary Examiner* — Stephen M. Gravini
(74) *Attorney, Agent, or Firm* — James E. Howard; Andre Pallapies

(57) ABSTRACT

A device for determining the conductance of laundry in a drier. The device comprises at least two electrodes (2) and means for dissipating heat from at least one part of at least one of said electrodes (2). The invention further relates to a drier comprising at least one area (5) for receiving laundry and at least two electrodes (2) for measuring the conductance of the laundry, at least one of the electrodes (2) at least partly bordering said receiving area (5). Means for cooling at least one part of at least one of the electrodes (2) are also provided inside the drier. Also disclosed is a method for preventing the formation of layers on electrodes (2) used for measuring conductance in a drier.

25 Claims, 5 Drawing Sheets

U.S. PATENT DOCUMENTS

| | | | | | |
|---|---|---|---|---|---|
| 2,109,131 | A | * | 2/1938 | Fisher | 204/560 |
| 2,384,660 | A | * | 9/1945 | Ward | 204/206 |
| 2,387,292 | A | * | 10/1945 | Preston | 38/25 |
| 2,399,964 | A | * | 5/1946 | Ward | 205/141 |
| 2,511,839 | A | * | 6/1950 | Frye | 34/255 |
| 2,513,431 | A | * | 7/1950 | Sell | 219/68 |
| 2,643,463 | A | * | 6/1953 | Grantham | 34/546 |
| 2,820,304 | A | * | 1/1958 | Horecky | 34/543 |
| 3,031,772 | A | * | 5/1962 | Sasnett | 34/82 |
| 3,059,693 | A | * | 10/1962 | Hotchkiss | 431/66 |
| 3,073,161 | A | * | 1/1963 | Crabtree | 73/335.02 |
| 3,100,521 | A | * | 8/1963 | Deubel | 431/24 |
| 3,122,426 | A | * | 2/1964 | Horecky | 34/531 |
| 3,141,957 | A | * | 7/1964 | Kelm | 392/439 |
| 3,186,105 | A | * | 6/1965 | Connaught et al. | 34/527 |
| 3,189,484 | A | * | 6/1965 | Sundman | 427/58 |
| 3,197,884 | A | * | 8/1965 | Smith | 34/532 |
| 3,200,511 | A | * | 8/1965 | Smith | 34/529 |
| 3,221,417 | A | * | 12/1965 | Mellinger | 34/528 |
| 3,260,104 | A | * | 7/1966 | King, Jr. | 73/24.06 |
| 3,261,389 | A | * | 7/1966 | Momchilovich et al. | 431/77 |
| 3,266,167 | A | * | 8/1966 | Finnegan | 34/543 |
| 3,277,949 | A | * | 10/1966 | Walbridge | 431/6 |
| 3,284,918 | A | * | 11/1966 | Malecki et al. | 34/547 |
| 3,286,363 | A | * | 11/1966 | Grimshaw | 34/546 |
| 3,287,817 | A | * | 11/1966 | Smith | 34/446 |
| 3,300,869 | A | | 1/1967 | Bergeson et al. | |
| 3,304,621 | A | * | 2/1967 | Nelson | 34/532 |
| 3,324,568 | A | * | 6/1967 | Nelson et al. | 34/532 |
| 3,327,403 | A | * | 6/1967 | Hood | 34/533 |
| 3,330,686 | A | * | 7/1967 | Rose | 427/302 |
| 3,335,501 | A | * | 8/1967 | Janke et al. | 34/528 |
| 3,338,288 | A | * | 8/1967 | Walker | 431/71 |
| 3,343,272 | A | * | 9/1967 | Janke et al. | 34/528 |
| 3,351,725 | A | * | 11/1967 | Gibson | 337/384 |
| 3,360,092 | A | * | 12/1967 | McConnell | 194/223 |
| 3,393,039 | A | * | 7/1968 | Eldridge, Jr. et al. | 431/70 |
| 3,394,466 | A | | 7/1968 | Heidtmann | |
| 3,394,467 | A | * | 7/1968 | Janke | 34/532 |
| 3,398,460 | A | * | 8/1968 | Elders | 34/533 |
| 3,399,948 | A | * | 9/1968 | Myers et al. | 431/68 |
| 3,402,478 | A | * | 9/1968 | Hetrick | 34/563 |
| 3,404,465 | A | * | 10/1968 | Charamond et al. | 34/533 |
| 3,405,452 | A | * | 10/1968 | Candor et al. | 34/251 |
| 3,409,994 | A | * | 11/1968 | Menk | 34/499 |
| 3,411,219 | A | | 11/1968 | Bartholomew | |
| 3,417,480 | A | * | 12/1968 | Thunander | 34/528 |
| 3,419,708 | A | * | 12/1968 | Niewyk et al. | 219/501 |
| 3,432,938 | A | * | 3/1969 | Miller | 34/533 |
| 3,436,838 | A | * | 4/1969 | Helfrich | 34/533 |
| 3,457,335 | A | * | 7/1969 | Elliott | 264/13 |
| 3,460,267 | A | * | 8/1969 | Lorenz | 34/533 |
| 3,470,716 | A | * | 10/1969 | Candor et al. | 68/4 |
| 3,471,938 | A | * | 10/1969 | Elders | 34/533 |
| 3,471,939 | A | * | 10/1969 | Janke | 34/533 |
| 3,475,830 | A | * | 11/1969 | Botts etal. | 34/533 |
| 3,484,177 | A | * | 12/1969 | Florio et al. | 431/254 |
| 3,488,131 | A | * | 1/1970 | Harter et al. | 431/24 |
| 3,491,456 | A | * | 1/1970 | Candor et al. | 34/251 |
| 3,491,458 | A | * | 1/1970 | Elders et al. | 34/533 |
| 3,497,964 | A | * | 3/1970 | Elders | 34/533 |
| 3,499,230 | A | * | 3/1970 | Slugantz | 34/533 |
| 3,508,850 | A | * | 4/1970 | Good | 431/2 |
| 3,521,377 | A | * | 7/1970 | Janke et al. | 34/563 |
| RE26,957 | E | * | 9/1970 | McConnell | 194/241 |
| 3,543,408 | A | * | 12/1970 | Candor et al. | 34/250 |
| 3,545,096 | A | * | 12/1970 | Robandt et al. | 34/547 |
| 3,546,783 | A | * | 12/1970 | Candor et al. | 34/250 |
| 3,575,193 | A | * | 4/1971 | Niewyk et al. | 137/119.01 |
| 3,599,342 | A | * | 8/1971 | Cotton | 34/393 |
| 3,603,805 | A | * | 9/1971 | Apel | 307/118 |
| 3,613,253 | A | * | 10/1971 | Smith | 34/532 |
| 3,613,254 | A | * | 10/1971 | Smith | 34/527 |
| 3,621,293 | A | * | 11/1971 | Heidtmann | 327/428 |
| 3,647,196 | A | * | 3/1972 | Cotton | 432/37 |
| 3,651,579 | A | * | 3/1972 | Smith | 34/532 |
| 3,660,909 | A | * | 5/1972 | Willcox | 34/533 |
| 3,667,130 | A | * | 6/1972 | Candor et al. | 34/250 |
| 3,691,097 | A | * | 9/1972 | Stiles et al. | 502/63 |
| 3,707,856 | A | * | 1/1973 | Niewyk et al. | 68/12.03 |
| 3,710,138 | A | * | 1/1973 | Cotton | 307/118 |
| 3,714,717 | A | * | 2/1973 | Beard et al. | 34/533 |
| 3,733,712 | A | * | 5/1973 | Smith | 34/532 |
| 3,757,426 | A | * | 9/1973 | Candor et al. | 34/251 |
| 3,782,001 | A | * | 1/1974 | Cotton | 34/532 |
| 3,818,604 | A | * | 6/1974 | Offutt et al. | 34/531 |
| 3,822,482 | A | * | 7/1974 | Cotton | 34/528 |
| 3,824,476 | A | * | 7/1974 | Cotton | 327/509 |
| 3,824,477 | A | * | 7/1974 | Cotton | 327/509 |
| 3,859,036 | A | * | 1/1975 | Schantz | 431/263 |
| 3,968,421 | A | * | 7/1976 | Marcade | 323/303 |
| 4,107,026 | A | * | 8/1978 | Freeman | 204/629 |
| 4,168,222 | A | * | 9/1979 | Freeman | 204/629 |
| 4,170,529 | A | * | 10/1979 | Freeman | 204/516 |
| 4,206,552 | A | * | 6/1980 | Pomerantz et al. | 34/445 |
| 4,207,153 | A | * | 6/1980 | Flood | 205/561 |
| 4,207,158 | A | * | 6/1980 | Freeman | 204/516 |
| 4,209,915 | A | * | 7/1980 | Keuleman et al. | 34/549 |
| 4,245,146 | A | * | 1/1981 | Shioi et al. | 219/553 |
| 4,260,872 | A | * | 4/1981 | Brodmann et al. | 219/270 |
| 4,298,789 | A | * | 11/1981 | Eichelberger et al. | 219/406 |
| 4,338,730 | A | * | 7/1982 | Tatsumi et al. | 34/569 |
| 4,385,451 | A | * | 5/1983 | Wesley | 34/562 |
| 4,385,452 | A | * | 5/1983 | Deschaaf et al. | 34/562 |
| 4,422,129 | A | * | 12/1983 | Briant et al. | 338/35 |
| 4,422,247 | A | * | 12/1983 | Deschaaf | 34/550 |
| 4,470,204 | A | * | 9/1984 | Wesley | 34/550 |
| 4,475,030 | A | * | 10/1984 | Bailey | 219/270 |
| 4,477,982 | A | * | 10/1984 | Cotton | 34/550 |
| 4,520,259 | A | * | 5/1985 | Schoenberger | 219/501 |
| 4,538,899 | A | * | 9/1985 | Landa et al. | 399/156 |
| 4,546,554 | A | * | 10/1985 | Bullock et al. | 34/554 |
| 4,622,759 | A | * | 11/1986 | Abe et al. | 34/546 |
| 4,649,654 | A | * | 3/1987 | Hikino et al. | 34/493 |
| 4,656,455 | A | * | 4/1987 | Tanino et al. | 338/35 |
| 4,698,259 | A | * | 10/1987 | Hervey | 428/378 |
| 4,738,034 | A | * | 4/1988 | Muramatsu et al. | 34/524 |
| 4,766,030 | A | * | 8/1988 | Hervey | 442/112 |
| 4,946,624 | A | * | 8/1990 | Michael | 510/101 |
| 4,983,814 | A | * | 1/1991 | Ohgushi et al. | 219/545 |
| 5,006,778 | A | * | 4/1991 | Bashark | 318/799 |
| 5,013,846 | A | * | 5/1991 | Walley | 548/338.1 |
| 5,047,255 | A | * | 9/1991 | Fujita | 426/418 |
| 5,055,171 | A | * | 10/1991 | Peck | 204/290.05 |
| 5,101,575 | A | * | 4/1992 | Bashark | 34/562 |
| 5,112,688 | A | * | 5/1992 | Michael | 428/402.2 |
| 5,126,061 | A | * | 6/1992 | Michael | 510/106 |
| 5,140,493 | A | * | 8/1992 | Janicek | 361/211 |
| 5,154,841 | A | * | 10/1992 | Tucker et al. | 510/520 |
| 5,166,592 | A | * | 11/1992 | Bashark | 318/799 |
| 5,172,490 | A | * | 12/1992 | Tatsumi et al. | 34/488 |
| 5,200,108 | A | * | 4/1993 | Yuasa et al. | 252/299.01 |
| 5,207,933 | A | * | 5/1993 | Trinh et al. | 510/517 |
| 5,211,827 | A | * | 5/1993 | Peck | 204/252 |
| 5,228,212 | A | * | 7/1993 | Turetta et al. | 34/493 |
| 5,232,612 | A | * | 8/1993 | Trinh et al. | 510/515 |
| 5,232,613 | A | * | 8/1993 | Bacon et al. | 510/101 |
| 5,234,611 | A | * | 8/1993 | Trinh et al. | 510/523 |
| 5,236,615 | A | * | 8/1993 | Trinh et al. | 510/349 |
| 5,254,285 | A | * | 10/1993 | Fujita | 252/175 |
| 5,281,956 | A | * | 1/1994 | Bashark | 340/660 |
| 5,301,438 | A | * | 4/1994 | Tanaka et al. | 34/550 |
| 5,332,521 | A | * | 7/1994 | Yuasa et al. | 252/299.01 |
| 5,355,425 | A | * | 10/1994 | Braiman et al. | 385/31 |
| 5,367,265 | A | * | 11/1994 | Gaudette | 307/650 |
| 5,367,429 | A | * | 11/1994 | Tsuchitani et al. | 361/280 |
| 5,397,499 | A | * | 3/1995 | Fujita | 252/175 |
| 5,454,171 | A | * | 10/1995 | Ikeda et al. | 34/492 |
| 5,465,197 | A | * | 11/1995 | Chien | 362/202 |
| 5,482,792 | A | * | 1/1996 | Faita et al. | 429/437 |
| 5,487,844 | A | * | 1/1996 | Fujita | 252/175 |
| 5,500,629 | A | * | 3/1996 | Meyer | 333/181 |
| 5,516,473 | A | * | 5/1996 | Bakeev et al. | 264/154 |
| 5,564,831 | A | * | 10/1996 | Bashark | 374/141 |
| 5,565,072 | A | * | 10/1996 | Faita et al. | 204/256 |
| 5,567,144 | A | * | 10/1996 | McCoy | 431/79 |
| 5,570,520 | A | * | 11/1996 | Huffington | 34/535 |

5,578,388 A * 11/1996 Faita et al. ..... 429/437
5,625,915 A * 5/1997 Radler et al. ..... 8/158
5,737,852 A * 4/1998 Shukla et al. ..... 34/528
5,767,062 A * 6/1998 Trinh et al. ..... 510/516
5,768,730 A * 6/1998 Matsumoto et al. ..... 8/159
5,804,219 A * 9/1998 Trinh et al. ..... 8/138
5,869,442 A * 2/1999 Srinivas et al. ..... 510/476
5,887,456 A * 3/1999 Tanigawa et al. ..... 68/20
5,899,684 A * 5/1999 McCoy et al. ..... 431/79
5,905,620 A * 5/1999 Becher et al. ..... 361/105
5,932,253 A * 8/1999 Trinh et al. ..... 424/719
5,940,986 A * 8/1999 Jelinek et al. ..... 34/528
5,962,400 A * 10/1999 Thomaides et al. ..... 510/471
5,972,196 A * 10/1999 Murphy et al. ..... 205/466
6,006,387 A * 12/1999 Cooper et al. ..... 8/158
6,020,698 A * 2/2000 Stenger et al. ..... 318/162
6,032,494 A * 3/2000 Tanigawa et al. ..... 68/12.06
6,047,486 A * 4/2000 Reck et al. ..... 34/491
6,067,845 A 5/2000 Meerpohl et al.
6,074,200 A * 6/2000 Bowman et al. ..... 431/278
6,083,892 A * 7/2000 Severns et al. ..... 510/220
6,098,306 A * 8/2000 Ramsey et al. ..... 34/257
6,098,310 A * 8/2000 Chen et al. ..... 34/475
6,099,295 A * 8/2000 McCoy et al. ..... 431/79
6,115,862 A * 9/2000 Cooper et al. ..... 8/158
6,126,312 A * 10/2000 Sakai et al. ..... 374/28
6,132,492 A * 10/2000 Hultquist et al. ..... 95/45
6,139,311 A * 10/2000 Bowman et al. ..... 431/278
6,160,110 A * 12/2000 Thomaides et al. ..... 536/29.1
6,197,858 B1 * 3/2001 Hagano et al. ..... 524/225
6,204,180 B1 * 3/2001 Tom et al. ..... 438/689
6,235,914 B1 * 5/2001 Steiger et al. ..... 554/114
6,246,040 B1 * 6/2001 Gunn ..... 219/771
6,267,864 B1 * 7/2001 Yadav et al. ..... 205/341
6,387,241 B1 * 5/2002 Murphy et al. ..... 205/626
6,388,185 B1 * 5/2002 Fleurial et al. ..... 136/205
6,420,507 B1 * 7/2002 Kale et al. ..... 526/348
6,428,717 B1 * 8/2002 Sakai et al. ..... 216/83
6,493,963 B1 * 12/2002 England ..... 34/491
6,519,871 B2 * 2/2003 Gardner et al. ..... 34/497
6,531,704 B2 * 3/2003 Yadav et al. ..... 250/493.1
6,554,608 B1 * 4/2003 Bowman et al. ..... 431/6
6,555,945 B1 * 4/2003 Baughman et al. ..... 310/300
6,589,312 B1 * 7/2003 Snow et al. ..... 75/255
6,620,210 B2 * 9/2003 Murphy et al. ..... 8/149.1
6,654,549 B1 * 11/2003 Konishi ..... 392/407
6,656,570 B1 * 12/2003 Fels et al. ..... 428/155
6,736,997 B2 * 5/2004 Olding et al. ..... 252/512
6,787,691 B2 * 9/2004 Fleurial et al. ..... 136/203
6,840,069 B2 * 1/2005 France et al. ..... 68/12.02
6,845,217 B2 * 1/2005 Konishi ..... 392/407
6,845,290 B1 * 1/2005 Wunderlin et al. ..... 700/208
6,868,289 B2 * 3/2005 Palti ..... 607/76
6,879,424 B2 * 4/2005 Vincent et al. ..... 359/265
6,906,842 B2 * 6/2005 Agrawal et al. ..... 359/265
6,922,017 B2 * 7/2005 Konishi et al. ..... 313/623
6,931,759 B2 * 8/2005 Jeong et al. ..... 34/485
6,941,674 B2 * 9/2005 Park et al. ..... 34/88
6,954,995 B2 * 10/2005 Kitamura et al. ..... 34/597
6,968,632 B2 * 11/2005 Guinibert et al. ..... 34/602
6,983,552 B2 * 1/2006 Park ..... 34/549
7,013,578 B2 * 3/2006 Wunderlin et al. ..... 34/528
7,020,982 B2 * 4/2006 Park et al. ..... 34/496
7,040,101 B2 * 5/2006 Takeda et al. ..... 62/78
7,043,855 B2 * 5/2006 Heilman et al. ..... 34/389
7,047,663 B2 * 5/2006 Zhang et al. ..... 34/348
7,065,905 B2 * 6/2006 Guinibert et al. ..... 34/603
7,081,225 B1 * 7/2006 Hollander ..... 422/24
7,089,054 B2 * 8/2006 Palti ..... 607/2
7,117,613 B2 * 10/2006 Guinibert et al. ..... 34/534
7,118,611 B2 * 10/2006 Snow et al. ..... 75/255
7,127,832 B2 * 10/2006 Park et al. ..... 34/562
7,134,857 B2 * 11/2006 Andrady et al. ..... 425/66
7,136,699 B2 * 11/2006 Palti ..... 607/2
7,146,210 B2 * 12/2006 Palti ..... 607/2
7,146,749 B2 * 12/2006 Barron et al. ..... 34/596
7,160,297 B2 * 1/2007 Nesbitt ..... 606/45
7,184,656 B2 * 2/2007 Konishi ..... 392/407
7,225,562 B2 * 6/2007 Guinibert et al. ..... 34/601
7,236,271 B2 * 6/2007 Silverbrook ..... 358/473
7,257,905 B2 * 8/2007 Guinibert et al. ..... 34/82
7,267,597 B2 * 9/2007 Konishi et al. ..... 445/27
7,268,190 B2 * 9/2007 Ohme et al. ..... 525/400
7,288,091 B2 * 10/2007 Nesbitt ..... 606/45
7,291,570 B1 * 11/2007 Green et al. ..... 442/123
7,312,973 B2 * 12/2007 Sekoguchi et al. ..... 361/231
7,320,184 B2 * 1/2008 Zhang et al. ..... 34/597
7,322,126 B2 * 1/2008 Beaulac ..... 34/554
7,327,087 B2 * 2/2008 Wang ..... 313/635
7,353,624 B2 * 4/2008 Chung et al. ..... 34/446
7,375,342 B1 * 5/2008 Wedding ..... 250/385.1
7,390,326 B2 * 6/2008 Nesbitt ..... 606/45
7,392,950 B2 * 7/2008 Walmsley et al. ..... 235/462.07
7,393,699 B2 * 7/2008 Tran ..... 438/1
7,412,783 B2 * 8/2008 Guinibert et al. ..... 34/572
7,415,781 B2 * 8/2008 Barron et al. ..... 34/595
7,432,725 B2 * 10/2008 Sieh et al. ..... 324/662
7,442,401 B2 * 10/2008 Tomaru ..... 427/1
7,466,444 B2 * 12/2008 Silverbrook et al. ..... 358/1.18
7,467,011 B2 * 12/2008 Palti ..... 607/2
7,467,483 B2 * 12/2008 Guinibert et al. ..... 34/601
7,478,486 B2 * 1/2009 Wunderlin et al. ..... 34/491
7,503,127 B2 * 3/2009 DuVal et al. ..... 34/381
7,519,420 B2 * 4/2009 Palti ..... 607/2
7,524,593 B2 * 4/2009 Ohnuma ..... 430/5
7,526,879 B2 * 5/2009 Bae et al. ..... 34/596
7,530,670 B2 * 5/2009 Matsushita et al. ..... 347/54
7,534,401 B2 * 5/2009 Keppel et al. ..... 422/186.21
7,550,541 B2 * 6/2009 Ohme et al. ..... 525/400
7,553,371 B2 * 6/2009 Dubrow et al. ..... 117/90
7,565,205 B2 * 7/2009 Palti ..... 607/76
7,565,206 B2 * 7/2009 Palti ..... 607/76
7,567,740 B2 * 7/2009 Bayindir et al. ..... 385/101
7,579,224 B2 * 8/2009 Kuwabara et al. ..... 438/151
7,588,970 B2 * 9/2009 Ohnuma et al. ..... 438/149
7,592,277 B2 * 9/2009 Andrady et al. ..... 442/340
7,599,745 B2 * 10/2009 Palti ..... 607/76
7,600,402 B2 * 10/2009 Shin et al. ..... 68/5 C
7,605,410 B2 * 10/2009 Takano et al. ..... 257/213
7,618,684 B2 * 11/2009 Nesbitt ..... 427/470
7,624,601 B2 * 12/2009 Ikemizu et al. ..... 68/17 R
7,628,467 B2 * 12/2009 Silverbrook ..... 347/32
7,632,740 B2 * 12/2009 Aoki et al. ..... 438/458
7,635,889 B2 * 12/2009 Isa et al. ..... 257/309
7,655,566 B2 * 2/2010 Fujii ..... 438/678
7,662,468 B2 * 2/2010 Bainbridge ..... 428/304.4
7,687,326 B2 * 3/2010 Morisue et al. ..... 438/149
7,700,932 B2 * 4/2010 Tomaru ..... 250/556
7,706,890 B2 * 4/2010 Palti ..... 607/76
7,715,036 B2 * 5/2010 Silverbrook et al. ..... 358/1.15
7,723,205 B2 * 5/2010 Kakehata ..... 438/431
7,732,330 B2 * 6/2010 Fujii ..... 438/678
7,732,349 B2 * 6/2010 Yamamoto ..... 438/783
2001/0000889 A1 * 5/2001 Yadav et al. ..... 204/242
2002/0004995 A1 * 1/2002 France et al. ..... 34/524
2002/0096984 A1 * 7/2002 Konishi et al. ..... 313/25
2002/0145134 A1 * 10/2002 Olding et al. ..... 252/500
2002/0171081 A1 * 11/2002 Vincent et al. ..... 257/40
2002/0174564 A1 * 11/2002 England ..... 34/606
2002/0179124 A1 * 12/2002 Van Hauwermeiren et al. ..... 134/34
2002/0184789 A1 * 12/2002 Gardner et al. ..... 34/491
2003/0039729 A1 * 2/2003 Murphy et al. ..... 426/320
2003/0041892 A1 * 3/2003 Fleurial et al. ..... 136/227
2003/0050220 A1 * 3/2003 Trinh et al. ..... 510/521
2003/0082972 A1 * 5/2003 Monfalcone et al. ..... 442/138
2003/0108460 A1 * 6/2003 Andreev et al. ..... 422/186.07
2003/0227664 A1 * 12/2003 Agrawal et al. ..... 359/269
2004/0007000 A1 * 1/2004 Takeda et al. ..... 62/78
2004/0035717 A1 * 2/2004 Yamamoto et al. ..... 205/704
2004/0037542 A1 * 2/2004 Kanishi ..... 392/407
2004/0048754 A1 * 3/2004 Herrmann et al. ..... 510/101
2004/0055176 A1 * 3/2004 Yang et al. ..... 34/549
2004/0060197 A1 * 4/2004 Jeong et al. ..... 34/595
2004/0068295 A1 * 4/2004 Palti ..... 607/2
2004/0068296 A1 * 4/2004 Palti ..... 607/2
2004/0068297 A1 * 4/2004 Palti ..... 607/2
2004/0073104 A1 * 4/2004 Brun del Re et al. ..... 600/372

2004/0089058 A1* 5/2004 De Haan et al. ..... 73/73
2004/0096169 A1* 5/2004 Sone et al. ..... 385/115
2004/0096202 A1* 5/2004 Konishi ..... 392/407
2004/0116792 A1* 6/2004 Nesbitt ..... 600/373
2004/0134090 A1* 7/2004 Heilman et al. ..... 34/209
2004/0143994 A1* 7/2004 Baron et al. ..... 34/597
2004/0152381 A1* 8/2004 York et al. ..... 442/76
2004/0168344 A1* 9/2004 Park ..... 34/606
2004/0172985 A1* 9/2004 Mamiya et al. ..... 68/12.05
2004/0175163 A1* 9/2004 Fukai et al. ..... 392/435
2004/0176804 A1* 9/2004 Palti ..... 607/2
2004/0200093 A1* 10/2004 Wunderlin et al. ..... 34/606
2004/0213899 A1* 10/2004 Wang ..... 427/67
2004/0216326 A1* 11/2004 Kitamura et al. ..... 34/597
2004/0237338 A1* 12/2004 Rump et al. ..... 34/607
2004/0242803 A1* 12/2004 Ohme et al. ..... 525/400
2004/0259750 A1* 12/2004 DuVal et al. ..... 510/276
2005/0022311 A1* 2/2005 Zhang et al. ..... 8/115.51
2005/0025956 A1* 2/2005 Bainbridge ..... 428/317.3
2005/0050758 A1* 3/2005 Park et al. ..... 34/425
2005/0050763 A1* 3/2005 Park et al. ..... 34/595
2005/0076535 A1* 4/2005 Guinibert et al. ..... 34/601
2005/0091878 A1* 5/2005 Yang et al. ..... 34/549
2005/0091879 A1* 5/2005 DuVal et al. ..... 34/597
2005/0092035 A1* 5/2005 Shin et al. ..... 68/275
2005/0115104 A1* 6/2005 Guinibert et al. ..... 34/601
2005/0136785 A1* 6/2005 Konishi et al. ..... 445/27
2005/0137542 A1* 6/2005 Underhill et al. ..... 604/361
2005/0168907 A1* 8/2005 Sekoguchi et al. ..... 361/230
2005/0179761 A1* 8/2005 Tomaru ..... 347/106
2005/0188471 A1* 9/2005 Ahn et al. ..... 8/158
2005/0197158 A1* 9/2005 Silverbrook et al. ..... 455/556.2
2005/0199408 A1* 9/2005 Keppel et al. ..... 174/36
2005/0200635 A1* 9/2005 Silverbrook ..... 347/2
2005/0200636 A1* 9/2005 Silverbrook et al. ..... 347/2
2005/0200638 A1* 9/2005 Silverbrook et al. ..... 347/2
2005/0209640 A1* 9/2005 Palti ..... 607/2
2005/0209641 A1* 9/2005 Palti ..... 607/2
2005/0209642 A1* 9/2005 Palti ..... 607/2
2005/0216291 A1* 9/2005 Shaheen et al. ..... 705/1
2005/0224998 A1* 10/2005 Andrady et al. ..... 264/10
2005/0240173 A1* 10/2005 Palti ..... 606/37
2005/0240228 A1* 10/2005 Palti ..... 607/2
2005/0241666 A1* 11/2005 Bodet et al. ..... 134/1
2005/0252028 A1* 11/2005 Park et al. ..... 34/528
2005/0278974 A1* 12/2005 Chung ..... 34/528
2006/0091398 A1* 5/2006 Yamaguchi et al. ..... 257/72
2006/0096117 A1* 5/2006 Chung et al. ..... 34/446
2006/0101943 A1* 5/2006 Snow et al. ..... 75/252
2006/0103316 A1* 5/2006 Wang ..... 313/635
2006/0115983 A1* 6/2006 Fujii et al. ..... 438/640
2006/0116000 A1* 6/2006 Yamamoto ..... 438/795
2006/0123654 A1* 6/2006 Zhang et al. ..... 34/348
2006/0139409 A1* 6/2006 Matsushita et al. ..... 347/55
2006/0162180 A1* 7/2006 Heilman et al. ..... 34/389
2006/0163743 A1* 7/2006 Kuwabara et al. ..... 257/773
2006/0166411 A1* 7/2006 Morisue et al. ..... 438/149
2006/0167499 A1* 7/2006 Palti ..... 607/2
2006/0170077 A1* 8/2006 Aoki et al. ..... 257/642
2006/0170111 A1* 8/2006 Isa et al. ..... 257/775
2006/0185403 A1* 8/2006 Ikemizu et al. ..... 68/12.18
2006/0186222 A1* 8/2006 Ikemizu et al. ..... 239/398
2006/0191161 A1* 8/2006 Wunderlin et al. ..... 34/562
2006/0204911 A1* 9/2006 Teng ..... 431/76
2006/0228435 A1* 10/2006 Andrady et al. ..... 425/174.8 R
2006/0233867 A1* 10/2006 Palti ..... 424/443
2006/0237019 A1* 10/2006 Palti ..... 128/846
2006/0241547 A1* 10/2006 Palti ..... 604/19
2006/0242858 A1* 11/2006 Beaulac ..... 34/446
2006/0248746 A1* 11/2006 Dittmer et al. ..... 34/534
2006/0249588 A1* 11/2006 Walmsley et al. ..... 235/494
2006/0250461 A1* 11/2006 Silverbrook et al. ..... 347/86
2006/0264140 A1* 11/2006 Andrady et al. ..... 442/341
2006/0272177 A1* 12/2006 Pezier et al. ..... 34/528
2006/0278875 A1* 12/2006 Ohnuma et al. ..... 257/66
2006/0293151 A1* 12/2006 Rast ..... 482/8
2007/0000068 A1* 1/2007 Gerard France et al. ..... 8/158
2007/0001225 A1* 1/2007 Ohnuma et al. ..... 257/347
2007/0004202 A1* 1/2007 Fujii ..... 438/678
2007/0006477 A1* 1/2007 Guinibert et al. ..... 34/85
2007/0026580 A1* 2/2007 Fujii ..... 438/149
2007/0028310 A1* 2/2007 Palti ..... 800/3
2007/0033660 A1* 2/2007 Palti ..... 800/3
2007/0037069 A1* 2/2007 Ohnuma ..... 430/5
2007/0037070 A1* 2/2007 Ohnuma et al. ..... 430/5
2007/0069401 A1* 3/2007 Kakehata ..... 257/E21.168
2007/0094888 A1* 5/2007 Barron et al. ..... 34/597
2007/0101602 A1* 5/2007 Bae et al. ..... 34/77
2007/0106294 A1* 5/2007 Nesbitt ..... 606/45
2007/0108068 A1* 5/2007 Suh et al. ..... 205/766
2007/0111391 A1* 5/2007 Aoki et al. ..... 438/118
2007/0120095 A1* 5/2007 Gruner ..... 252/500
2007/0123853 A1* 5/2007 Nesbitt ..... 606/45
2007/0144031 A1* 6/2007 Lee ..... 34/446
2007/0153353 A1* 7/2007 Gruner ..... 359/245
2007/0153362 A1* 7/2007 Gruner ..... 359/315
2007/0153363 A1* 7/2007 Gruner ..... 359/315
2007/0163056 A1* 7/2007 Lee et al. ..... 8/149.2
2007/0170071 A1* 7/2007 Suh et al. ..... 205/687
2007/0182976 A1* 8/2007 Silverbrook ..... 358/1.12
2007/0186440 A1* 8/2007 Guinibert et al. ..... 34/603
2007/0190880 A1* 8/2007 Dubrow et al. ..... 442/181
2007/0193279 A1* 8/2007 Yoneno et al. ..... 62/3.3
2007/0194323 A1* 8/2007 Takano et al. ..... 257/72
2007/0214678 A1* 9/2007 Son et al. ..... 34/446
2007/0216424 A1* 9/2007 Sieh et al. ..... 324/662
2007/0220683 A1* 9/2007 Kim ..... 8/158
2007/0220776 A1* 9/2007 Guinibert et al. ..... 34/603
2007/0243124 A1* 10/2007 Baughman et al. ..... 423/447.1
2007/0260019 A1* 11/2007 Ohme et al. ..... 525/400
2007/0285843 A1* 12/2007 Tran ..... 360/245.9
2007/0295973 A1* 12/2007 Jinbo et al. ..... 257/88
2008/0032060 A1* 2/2008 Nesbitt ..... 427/470
2008/0050509 A1* 2/2008 Nesbitt ..... 427/2.12
2008/0052951 A1* 3/2008 Beaulac ..... 34/549
2008/0052954 A1* 3/2008 Beaulac ..... 34/572
2008/0107822 A1* 5/2008 Selwyn et al. ..... 427/535
2008/0134445 A1* 6/2008 Cho et al. ..... 8/149.1
2008/0138651 A1* 6/2008 Doi et al. ..... 428/690
2008/0141550 A1* 6/2008 Bae et al. ..... 34/68
2008/0148494 A1* 6/2008 Son et al. ..... 8/149.3
2008/0148596 A1* 6/2008 Son et al. ..... 34/486
2008/0161046 A1* 7/2008 Walmsley et al. ..... 455/556.1
2008/0168679 A1* 7/2008 Son et al. ..... 34/497
2008/0170982 A1* 7/2008 Zhang et al. ..... 423/447.3
2008/0176046 A1* 7/2008 Yamaguchi et al. ..... 428/195.1
2008/0180026 A1* 7/2008 Kondo et al. ..... 313/506
2008/0182076 A1* 7/2008 Kondo et al. ..... 428/172
2008/0184588 A1* 8/2008 Somod et al. ..... 34/495
2008/0236208 A1* 10/2008 Miyata et al. ..... 68/5 C
2008/0268732 A1* 10/2008 Green et al. ..... 442/117
2008/0289971 A1* 11/2008 Shigihara et al. ..... 205/687
2008/0296555 A1* 12/2008 Miller et al. ..... 257/14
2008/0299006 A1* 12/2008 Ikemizu ..... 422/62
2008/0302138 A1* 12/2008 Bae et al. ..... 68/12.05
2008/0305240 A1* 12/2008 Tomaru ..... 427/1
2008/0307667 A1* 12/2008 Ikemizu ..... 34/132
2008/0313922 A1* 12/2008 Bae et al. ..... 34/491
2008/0319372 A1* 12/2008 Palti et al. ..... 604/20
2009/0000040 A1* 1/2009 Ikemizu ..... 8/158
2009/0001200 A1* 1/2009 Imahori et al. ..... 239/700
2009/0004822 A1* 1/2009 Murakami et al. ..... 438/458
2009/0010801 A1* 1/2009 Murphy et al. ..... 422/4
2009/0025250 A1* 1/2009 Koo et al. ..... 34/491
2009/0030132 A1* 1/2009 Kumazawa et al. ..... 524/493
2009/0038178 A1* 2/2009 Ahn et al. ..... 34/557
2009/0043346 A1* 2/2009 Palti et al. ..... 607/2
2009/0049709 A1* 2/2009 Doh ..... 34/524
2009/0061131 A1* 3/2009 Monfalcone et al. ..... 428/35.6
2009/0073325 A1* 3/2009 Kuwabara et al. ..... 348/790
2009/0074389 A1* 3/2009 Noe et al. ..... 392/314
2009/0083990 A1* 4/2009 Bae et al. ..... 34/486
2009/0097805 A1* 4/2009 Bayindir et al. ..... 385/101
2009/0098908 A1* 4/2009 Silverbrook et al. ..... 455/556.1
2009/0100882 A1* 4/2009 Bae et al. ..... 68/5 C
2009/0113745 A1* 5/2009 Choi et al. ..... 34/139
2009/0113755 A1* 5/2009 Choi et al. ..... 34/390
2009/0126220 A1* 5/2009 Nawrot et al. ..... 34/497

2009/0126222 A1* 5/2009 Bae et al. ..... 34/527
2009/0126420 A1* 5/2009 Tsunemine et al. ..... 68/5 C
2009/0133281 A1* 5/2009 Yoon et al. ..... 34/72
2009/0143227 A1* 6/2009 Dubrow et al. ..... 502/406
2009/0148342 A1* 6/2009 Bromberg et al. ..... 422/37
2009/0153762 A1* 6/2009 Kuwabara et al. ..... 349/43
2009/0158750 A1* 6/2009 Rubin ..... 62/3.2
2009/0169158 A1* 7/2009 Bayindir et al. ..... 385/101
2009/0172969 A1* 7/2009 Kim ..... 34/491
2009/0173082 A1* 7/2009 Rubin ..... 62/3.3
2009/0176073 A1* 7/2009 Ohnuma ..... 428/195.1
2009/0179092 A1* 7/2009 Akisada et al. ..... 239/690
2009/0183188 A1* 7/2009 Ashizaki et al. ..... 720/601
2009/0200948 A1* 8/2009 Selwyn ..... 315/111.21
2009/0216182 A1* 8/2009 Lauchard et al. ..... 604/65
2009/0225050 A1* 9/2009 Toyomaki ..... 345/173
2009/0233057 A1* 9/2009 Aksay et al. ..... 428/195.1
2009/0243065 A1* 10/2009 Sugino et al. ..... 257/686
2009/0255299 A1* 10/2009 Hiro et al. ..... 68/19
2009/0260256 A1* 10/2009 Beaulac ..... 34/528
2009/0265953 A1* 10/2009 Bae et al. ..... 34/467
2009/0274985 A1* 11/2009 McKnight et al. ..... 431/36
2009/0275678 A1* 11/2009 Kumazawa et al. ..... 523/523
2009/0286147 A1* 11/2009 Nakajima et al. ..... 429/145
2009/0288456 A1* 11/2009 Bae et al. ..... 68/5 R
2009/0313848 A1* 12/2009 Moschutz et al. ..... 34/549
2010/0000117 A1* 1/2010 Choi et al. ..... 34/443
2010/0000269 A1* 1/2010 Shin et al. ..... 68/5 C
2010/0011611 A1* 1/2010 Kim et al. ..... 34/390
2010/0011614 A1* 1/2010 Doh ..... 34/493
2010/0015764 A1* 1/2010 Ohnuma et al. ..... 438/155
2010/0024462 A1* 2/2010 Kamisako et al. ..... 62/331
2010/0038618 A1* 2/2010 Takano et al. ..... 257/2
2010/0062569 A1* 3/2010 Aoki et al. ..... 438/118
2010/0077770 A1* 4/2010 Kamisako et al. ..... 62/3.6
2010/0077791 A1* 4/2010 Kamisako et al. ..... 62/373
2010/0081471 A1* 4/2010 Silverbrook ..... 455/556.1
2010/0081913 A1* 4/2010 Cross et al. ..... 600/386
2010/0085684 A1* 4/2010 Suh et al. ..... 361/503
2010/0099217 A1* 4/2010 Isa et al. ..... 438/104
2010/0149582 A1* 6/2010 Silverbrook et al. ..... 358/1.14
2010/0242547 A1* 9/2010 Nakada et al. ..... 68/139
2010/0307724 A1* 12/2010 Ichii et al. ..... 165/121

FOREIGN PATENT DOCUMENTS

FR 2820304 A1 * 8/2002
JP 60253164 A * 12/1985
JP 06170096 A * 6/1994
JP 07229867 A * 8/1995
JP 2002273099 A * 9/2002
JP 2010187742 A * 9/2010
WO WO 97/32071 9/1997
WO WO 2004059072 A1 * 7/2004

* cited by examiner

DEVICE FOR DETERMINING THE CONDUCTANCE OF LAUNDRY, DRYERS AND METHOD FOR PREVENTING DEPOSITS ON ELECTRODES

The invention relates to a device for determining the conductance of laundry, a dryer and a method for preventing depositing on electrodes for conductance measuring.

In modern dryers, in particular in domestic dryers, the wash moisture in the laundry is measured for controlling the dryer, in particular for achieving desired residual moisture in the laundry. This measuring is preferably carried out according to the principle of conductance measuring.

As a rule two electrodes are applied to the laundry for this purpose, whereby one of the electrodes can represent for example the laundry drum and the second electrode can be a carrier installed against and insulated from the drum. Voltage is applied to the two electrodes via a resistor, and the result is a current through the laundry. The laundry voltage falling on the laundry is measured on the electrodes and from this determines the conductance, which is proportional to the moisture content in the laundry.

It was established in particular with fixed electrodes that a drift in measuring results had been set after repeated use. Tests have proven that this is caused by the development of deposits in the form of layers on the electrodes made by water contents and laundry substances. The transfer resistance occurring from the layers in addition is measured and the result of the wash moisture measuring is thus falsified by these layers, which for example can comprise lime and silicate, during measuring of the wash moisture. This means for example that targeted adjusting of residual moisture in the laundry is no longer guaranteed. On completion of the drying program the final residual moisture of the laundry is rather shifted in the direction of moister laundry. To remove the layers it was suggested to clean the electrode surfaces with acidic cleaning fluids so as to restore the functionality of the wash moisture measuring. This is expensive for one and also the electrodes can be difficult to access for the user, depending on the selected installation site.

The object of the invention is therefore to provide a device for measuring the wash moisture, a laundry dryer and a process for preventing layer build-up on electrodes in a laundry dryer, by means of which the development of layers on electrodes can be prevented or at least sharply reduced such that also precise determining of the wash moisture is enabled after repeated use, without the electrodes having to be cleaned by the user. In addition the device and the laundry dryer should have a simple construction.

The idea of the invention is that through targeted adjusting of a certain temperature on the electrode surfaces the build-up of layers can be prevented or at least decreased.

This task is therefore solved according to the present invention by a device for determining the conductance of laundry in a laundry dryer, which comprises at least two electrodes, whereby the device comprises means for heat elimination from at least one part of at least one of the electrodes.

In dryers a receiving area for the laundry to be dried is provided, which generally is a laundry drum. Through providing means for heat elimination from at least one part of the electrodes at least the surface of at least one of the electrodes, which is facing the receiving area or respectively borders on the latter, can be cooled. This drop in temperature of the electrodes can prevent evaporation of water on the electrodes, which can lead to the build-up of deposits of water contents and laundry fluids residues. A build-up of layers, which falsify the measuring results of the conductance measuring, can thus be prevented. In addition the condensation of moist-warm air in the drum interior on the electrodes can lead to the solution of water and laundry fluid contents on the electrodes being diluted and the fallout of dissolved minerals is prevented.

With means for heat elimination being provided on the rear of the electrodes particularly simple and advantageous heat elimination is guaranteed.

In one embodiment the means for cooling the electrodes represent means for improving radiation of heat from the electrodes. This embodiment is offered in cases where the electrodes are installed in positions, in which the side of the electrodes, averted from the drum interior, borders on a space, in which a lower temperature prevails than in the laundry drum. So for example the rear of the electrodes, that is, the side of the electrodes, facing away from the inside of the laundry drum, can be provided with a black coating, by which the radiation of heat in this direction is improved. It is also possible to improve the heat radiation by roughening the rear of the electrodes.

Alternatively or in addition the means can have cooling surfaces, which are connected to the electrodes. These cooling surfaces can lead, either by heat radiation or by additional cooling of the cooling surfaces by an appropriate coolant, such as for example air, to lowering of the temperature of the electrodes, in particular of the surface of the electrodes facing the drum interior.

According to the present invention the means for cooling the electrodes can also comprise means for air supply. By guiding colder air from other parts of the dryer along or onto the electrodes, in particular along or onto the electrode surface, facing the drum, the temperature of the electrodes can be lowered.

According to a preferred embodiment the means for air supply are formed by defined faulty air openings in the vicinity of the electrodes. Ambient air can be conveyed to the electrodes via these faulty openings. In terms of this invention passages are designated as faulty air openings, via which colder air from other areas of the dryer or respectively from its surroundings can be conveyed to the electrodes. The faulty air openings can also be designed in the form of pipes. The faulty air openings however preferably constitute gaps.

The means can also comprise an additional fan for raising the flow speed, or a source of pressurised air.

The electrodes of the inventive device are particularly preferably fixed in the laundry dryer. Due to this configuration costly contacting of the electrode, as is required for online electrodes, can be omitted. With the inventive device depositing on the electrodes can be avoided, although the elimination of deposits does not apply to a large extent through friction with the laundry, which is moved in the drum, as this occurs with carrier electrodes.

According to a further aspect of the invention the problem is solved by a laundry dryer, which comprises at least one receiving area for laundry and at least two electrodes for measuring the conductance of the laundry, whereby at least one of the electrodes borders at least partially on the receiving area, whereby means are provided in the laundry dryer for cooling at least a part of at least one of the electrodes.

The means used in the laundry dryer for heat elimination can be designed as described in Claims 2 to 6. These can thus comprise means for improving the radiation of heat, cooling surfaces, means for air supply or respectively a fan or a source of compressed air.

In one embodiment, with the inventive laundry dryer, in particular with the dryer according to the exhaust air type, means are provided, by which subpressure can be adjusted in the receiving area of the dryer. In addition to this the means for cooling in this embodiment constitute defined faulty air openings, via which the electrodes can be supplied with ambient air. The air supply in the inventive laundry dryer can be adjusted ideally by providing means for generating subpressure.

Colder ambient air can reach the electrodes and in particular the electrode surface via this subpressure through the faulty air openings. A fan can be used for example to generate the subpressure.

The build-up of deposits on the electrodes can easily be prevented by this adjusting of the air current into the laundry dryer.

The electrodes are preferably installed fixed in the laundry dryer.

The latter are arranged particularly preferably in the region of the front end shield. In this configuration the inventive effect of preventing the build-up on the electrodes can be utilised particularly advantageously, since other mechanisms can be utilised at this installation point only minimally for eliminating the layers, such as for example friction with the laundry in the drum.

The task is finally solved by a process for preventing layer deposits on electrodes for measuring moisture in a laundry dryer, whereby the temperature of the electrodes is controlled by means for heat elimination. The electrodes are preferably cooled at least partially by this.

The means for heat elimination, which can be used according to the present invention for controlling heat elimination, can be designed as in Claims 2 to 6. These can thus comprise means for improving the radiation of heat, cooling surfaces, means for air supply or respectively a fan or a source of compressed air.

It is particularly preferable to bring the electrodes to a temperature, which is below the processing temperature in the laundry dryer, preferably below the temperature of surfaces, adjacent to the electrodes. The difference in temperature is preferably set at least at one degree Kelvin (1 K). Adjoining surfaces are for example the front floor or the front drum mantle of the laundry drum. Whereas on the relatively cooler electrodes solutions of water and laundry fluids contents optionally applied by the laundry through condensation of the moist warm air are diluted, on the relatively warmer metallic surfaces in the environment the solution of evaporating water is further concentrated, which leads to the depositing of minerals and thus to forming of layers on these relatively warmer surfaces. The electrode surfaces required for the conductance measuring however remain free of deposits.

Cooling of the electrodes can be achieved in different ways. In one embodiment the electrodes are cooled by air cooling. The particular advantage of this type of cooling in which a focused cool-air supply is directed to at least one part of the electrodes is that the air located in the dryer outside the laundry drum can be used as coolant can and thus bringing more coolant into the laundry dryer is unnecessary. For this reason a preferred embodiment of the process in particular in dryers according to the exhaust air type is characterised in that subpressure is adjusted in a receiving area for laundry in the laundry dryer and the electrodes are supplied with cool air, in that ambient air is sent to the electrodes via defined faulty air openings.

The advantages and characteristics of the inventive device or respectively of the inventive dryer apply accordingly also for the inventive process and vice versa respectively.

The invention will be described hereinafter by means of the attached diagrams, which illustrate a non-limiting example of a possible embodiment of the invention, in which.

Figure 1:
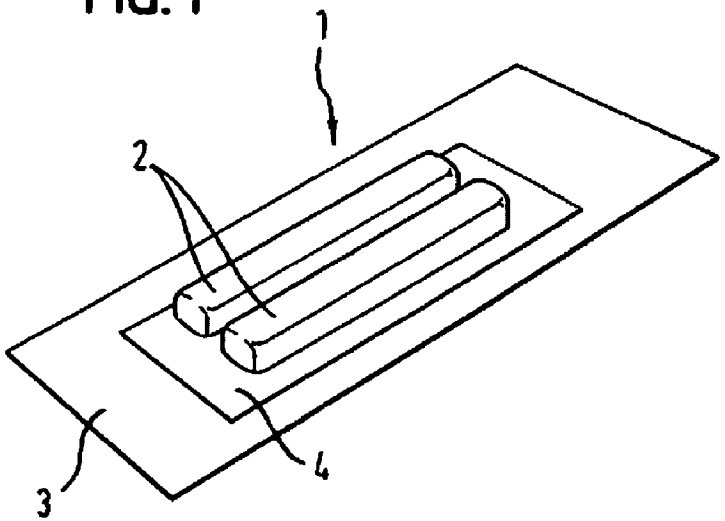
FIG. 1 is a perspective view of an embodiment of an inventive device for measuring wash moisture.

FIG. 1 illustrates an embodiment of an inventive device 1 in perspective view. Devices for measuring the conductance are known extensively from the prior art, so that in the figures only elements of the device are shown, which are essential to the invention. The device 1 comprises two electrodes 2, which extend in each case longitudinally and are arranged parallel to one another. The electrodes 2 are held on one component 3, whereby a retaining frame 4 is provided for fastening the electrodes 2. This can be connected so as to latch with the component 3. The component 3 can for example constitute the front end shield or respectively a part of the mounting of the drum. As is evident from FIG. 2, the component 3 in the illustrated embodiment has a depression 31, which corresponds to the size of the retaining frame 4 and serves to receive the retaining frame 4. Provided in the depression 31 are openings 32, which extend through the component 3 and are provided in the illustrated design in each case with pipe extensions 33. The pipe extensions 33 extend in the state in which the electrodes 2 are fastened to the component 3, in the interior of the electrodes 2.

Figure 2:
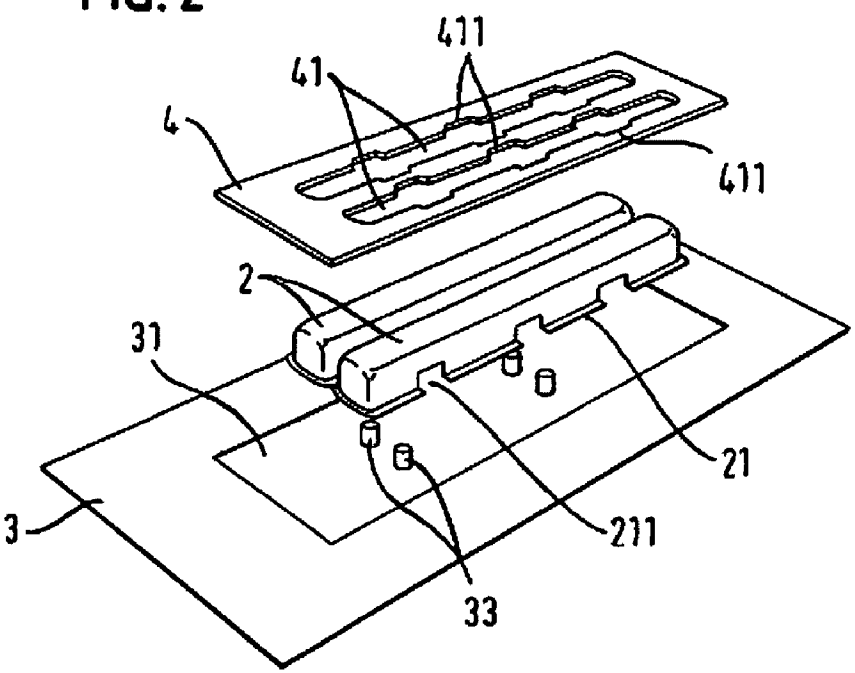
FIG. 2 is an exploded view of the embodiment of the inventive shown device in FIG. 1.
Figure 3:
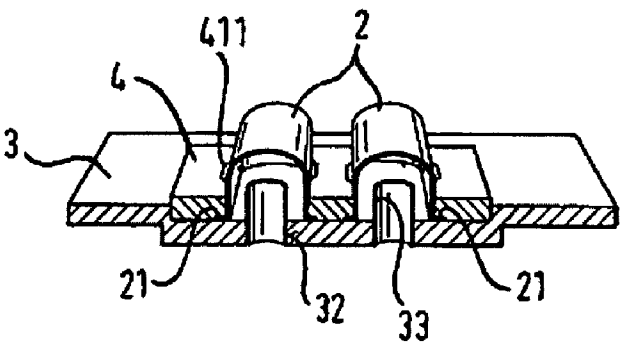
FIG. 3 is a schematic sectional view through the embodiment of the inventive device shown in FIG. 1.
Figure 4:
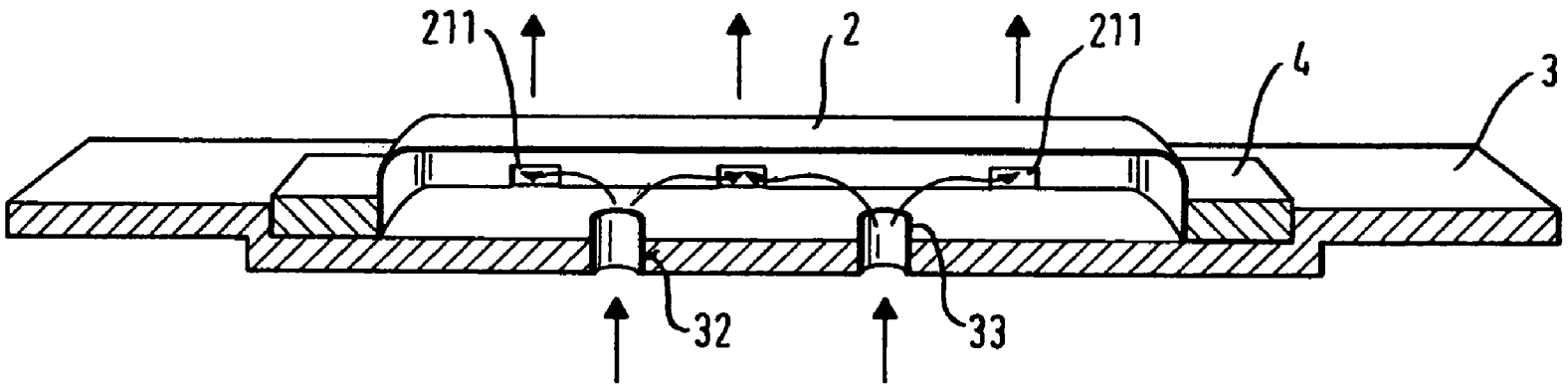
FIG. 4 is a schematic longitudinal view through the embodiment of the inventive device shown in FIG. 1.
Figure 6:
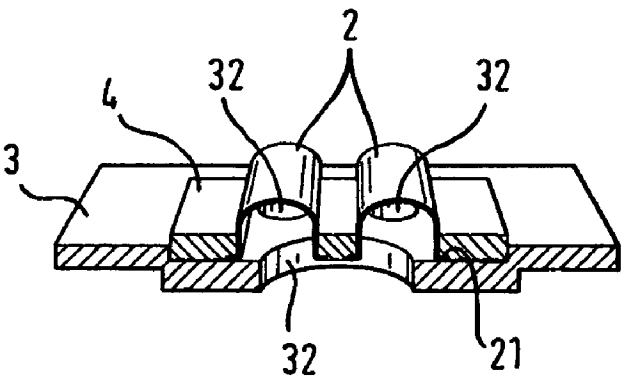
FIG. 5 to 7 illustrate an embodiment of an inventive device for measuring wash moisture compared to the modified device shown in FIGS. 2 to 4.
Figure 5:
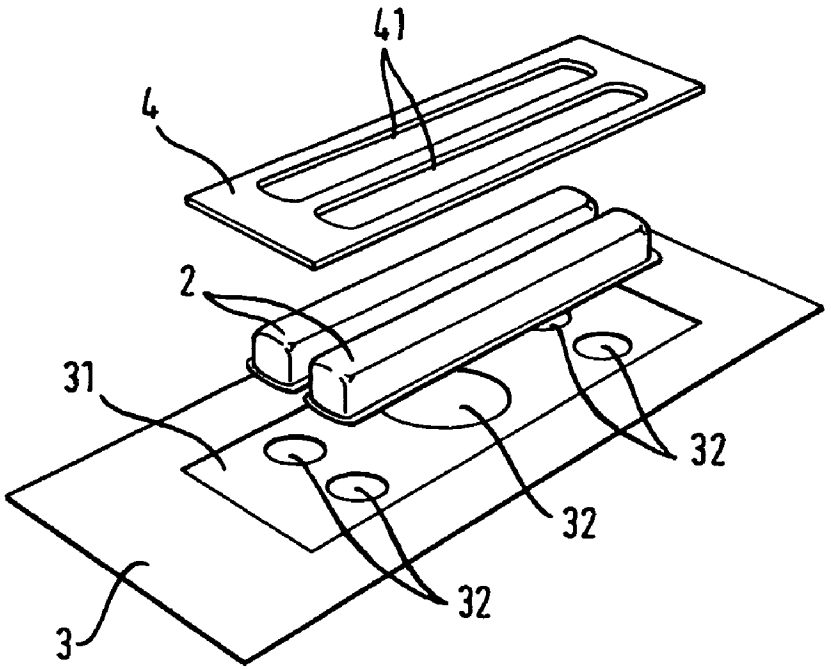
Figure 7:
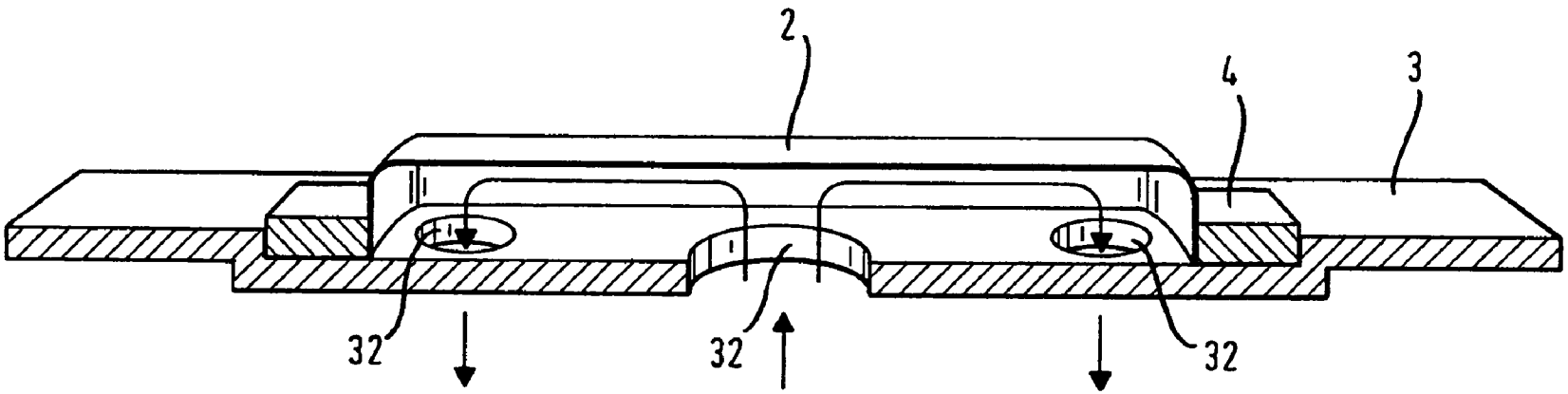

In contrast to the design illustrated in FIGS. 2 to 4 in FIGS. 5 to 7 the component 3 attached backwards to the electrodes 2 is provided with a central opening 32 for supplying cool air and with two side openings 32 for discharge of cool air. In this way the current of cool air enters in the centre and divides into two partial streams, so that uniform cooling of the electrodes is ensured.

The electrodes 2 in each case have a pan form, whereby the opening of the pan is facing the component 3. A flange 21, which is interrupted over the length of the electrodes 2 at several positions (in this case three) by recesses 211 extends outwards at the edge of the pan opening on each electrode 2. The recesses 211 preferably extend over the flange 21 in the direction of the pan floor of electrodes 2. The retaining frame 4 has two longitudinal grooves 41, corresponding to the form of the electrodes 2. Provided over the length of the longitudinal grooves 41 at positions, which correspond to the positions of the recesses 211 on the electrodes 2, are extensions 411 of the longitudinal groove 41.

As shown in FIG. 3, in the assembled state the pipe extensions 33, which are provided on the component 3, project into the interior of the electrodes 2, i.e. in the pan form, but do not contact the pan floor.

FIG. 4 shows a longitudinal section through the embodiment of the device 1 shown in FIG. 1. An embodiment of the inventive process will now be explained with reference to this diagram.

In a laundry dryer according to the exhaust air type, which works on the suction principle, a certain subpressure prevails in the laundry drum determined by the type of construction. Using the inventive device 1 in such a laundry dryer results in the following current behaviour. Colder air outside the drum is directed via the openings 32 in the component 3 and via the connected pipe extensions 33 into the interior of the pan-shaped electrodes 2. There the air flow is directed via the extensions 411 of the longitudinal grooves 41 in the retaining frame 4 thus cooperating via the recesses 211 on the electrodes 2 into the interior 5 of the laundry drum. By way of this air supply the inside of the electrodes is kept constantly cool. Each of the electrodes 2 experiences a certain cooling from this. In addition, the surface of the electrodes 2, facing the drum interior 5, is additionally cooled by cooler air brushing past this surface of the electrode 2. The cooling thus takes place via the channel formed by the openings 32, the pipe sections 33 and the inside of the electrodes 2, as well as via the defined gap leakage formed by the recesses 211 and extensions 411. This results in ideal cooling and fallout of minerals and the formation of layers, which falsify the measuring results, can thus be avoided.

Figure 8:
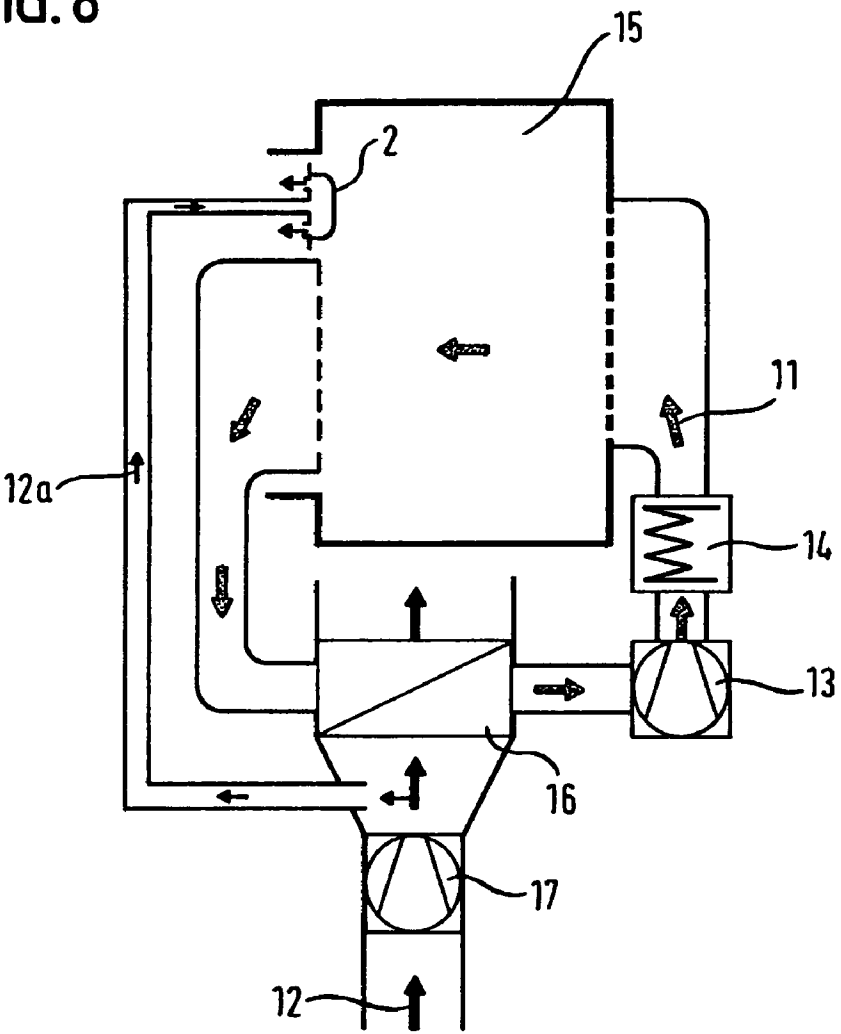
FIG. 8 shows a laundry dryer according to the condensation construction with an inventive device for measuring wash moisture.

FIG. 8 illustrates a laundry dryer according to the condensation type, which has a processing air stream 11 and a current of cool air 12 for cooling the processing air current 11. The processing air current 11 is guided via a fan 13, a heating unit 14, a drum 15, a slubbing sieve (not illustrated) and a condenser 16 in a closed circuit. The condenser 16 is cooled via the current of cool air 12 generated by means of a fan 17. A partial current of cool air 12*a* is branched off between the fan and the condenser from the current of cool air 12 and directed to the rear of the electrodes 2.

The current of cool air 12 for the condenser 16 can also be used for cooling the electrodes 2 in an advantageous manner.

The invention is not restricted to the illustrated embodiments. With the inventive device the air channel for flowing through the electrodes and flowing past the surface of the electrodes can also be formed by other means than the illustrated recesses and extensions. For example slots can be formed through which the colder air can reach the surface of the electrodes from the inside of the electrodes. Should the invention be realised on a dryer, which does not work according to the above suction principle, instead of using the subpressure in the laundry drum a fan can be used to guide cooler air to the electrodes from outside the drum via suitable channels or via defined gap leakages.

It is further possible to configure electrodes in such a way that they are provided on the side averted from the interior of the laundry drum with a coating, for example a black film, or cooling surfaces are provided on this side. If the electrodes are arranged for example in the region of the front end shield, these cooling surfaces can extend in the space between the end shield and the front wall of the unit.

Alternatively or additionally the flow rate of the air behind the electrodes can be increased, through which the elimination of heat of the electrodes can be increased and its temperature can thus be lowered.

With the inventive device, the laundry dryer and the inventive process a temperature difference between the electrodes and adjacent surfaces of at least 0.8 K, preferably at least 1 K and particularly preferably at least 1.2 K can preferably be set.

Also the form of the electrodes is not limited to the form in question. The electrodes can for example also be designed flat, or exhibit a v-shaped cross-section. Likewise, ways other than the above type of fastening of the electrodes can be used on the component. Known latching means can be considered for this purpose.

The cooling of the electrodes can, as can be inferred from the description, be carried out via direct cooling of the surface of the electrodes facing the drum interior. Alternatively or in addition to this the heat elimination and thus the cooling can take place indirectly via the rear side of the electrode.

In summary the present invention creates the possibility of reliably determining the conductance of laundry, which is to be dried in a dryer, without the user having to manually clean the electrodes used for measuring.

The invention claimed is:

1. A device for determining the conductance of laundry in a laundry dryer, which comprises:

at least two electrodes, each fixed to a respective receiving area of the laundry dryer; and means for heat reduction from at least a part of at least one of the electrodes, the means for heat reduction operating to reduce a temperature of the part of the at least one electrode below a temperature of the respective receiving area of the laundry dryer.

2. The device as claimed in claim 1, wherein the means for heat reduction is arranged on a rear side of the electrodes opposite to a side of the electrodes that face a laundry receiving area of the laundry dryer, such that the rear side of the electrodes is the first area of the electrodes from which the means for heat reduction draws heat.

3. The device as claimed in claim 1, wherein the means for heat reduction includes at least one of means for improving radiation of heat from the electrodes and cooling surfaces, which are connected to the electrodes.

4. The device as claimed in claim 1, wherein the means for heat reduction comprises means for air supply and the electrodes are arranged on a component in which openings are formed, cool air being supplied and removed from the electrodes, whereby the cool air is supplied through a middle opening and the cool air is removed through at least one side opening.

5. The device as claimed in claim 4, wherein the means for air supply are formed by defined faulty air openings in the vicinity of the electrodes, through which ambient air can be conveyed to the electrodes.

6. The device as claimed in claim 4, wherein the means for air supply comprises at least one of a fan and a source of compressed air.

7. The device as claimed in claim 4, wherein the air supply means comprises at least one of a fan and a source of compressed air.

8. The device as claimed in claim 1, wherein the electrodes are built fixed in the laundry dryer.

9. The device as claimed in claim 1, wherein the electrodes form a voltage applying arrangement and this voltage applying arrangement is arranged on the laundry dryer relative to a laundry receiving area of the laundry dryer so that a voltage applied to the voltage applying arrangement results in a current passing through laundry retained in the laundry receiving area and the voltage of this current is measured at the voltage applying arrangement.

10. The device as claimed in claim 9, wherein the respective one electrode whose heat is reduced by the means for heat reduction is exposed to an interior of the laundry receiving area of the laundry dryer to an extent that the respective one electrode is contacted by liquid entrained in a liquid-air mixture in the interior of the laundry receiving area of the laundry dryer and the device is operable to reduce the heat of the respective one electrode to a level at which the respective one electrode substantially avoids evaporating such entrained liquid.

11. The device as claimed in claim 9, wherein the laundry receiving area is a rotating drum and the electrode is mounted relative to the rotating drum such that the electrode is exposed to a solution of water and laundry fluid that is moving within the drum.

12. The device as claimed in claim 1, wherein the at least two electrodes are in the form of a first electrode and a second electrode, the first electrode having an exposed side that is exposed to a moist air mixture in a laundry receiving area of the laundry dryer in which laundry is retained, the moist air mixture occurring when laundry in the laundry receiving area is subjected to a drying operation that results in moisture initially retained by the laundry being released into surrounding air as the laundry is dried and the surrounding air increasing in its moisture content as a consequence thereof, the device being operable to apply a voltage to the second electrode and the first electrode that results in a current passing through laundry retained in the laundry receiving area, thereby permitting a voltage measurement proportional to a moisture content of the laundry, the device applying a voltage such that the exposed side of the first electrode can reach an evaporation enabling temperature sufficient to evaporate liquid in the moist air mixture in contact with the exposed side of the first electrode in the absence of a heat abatement measure, and the means for heat reduction from at least a part of at least one of the electrodes operating to reduce heat from the first electrode such that the exposed side of the first electrode is substantially prevented from reaching the evaporation enabling temperature in spite of the application by the device of a voltage that would otherwise cause the exposed side of the first electrode to reach the evaporation enabling temperature.

13. A laundry dryer, comprising:

an electrode of a moisture sensor fixed to a respective receiving area of the laundry dryer; and a cooler that cools the electrode, the cooler operating to reduce a temperature of the electrode below a temperature of the respective receiving area of the laundry dryer.

14. The laundry dryer as claimed in claim 13, further comprising a laundry receiving area in which laundry to be dried is received, wherein the respective receiving area of the electrode is located in the laundry receiving area of the dryer.

15. The laundry dryer of claim 14, wherein the cooler comprises a pipe inside the electrode.

16. The laundry dryer of claim 15, wherein the cooler further comprises an opening defined by the electrode.

17. The laundry dryer of claim 16, wherein the cooler cools the electrode by permitting air flow through the pipe and the opening.

18. The laundry dryer of claim 15, wherein the cooler comprises a component having a plurality of openings that permit air flow between the plurality of openings.

19. The laundry dryer of claim 14, wherein the cooler permits air to flow from outside of a drum of the laundry dryer into the interior of the electrode to cool the electrode.

20. The laundry dryer of claim 14, further comprising:

a first fan that circulates a first stream of air across a heater, through a drum, and past one side of a condenser to condense moisture from the first stream of air;

a second fan that supplies a second stream of air to cross the other side of the condenser to remove heat from the first stream of air as it crosses the condenser; and a conduit that provides a partial current of the second stream of air to the cooler.

21. The laundry dryer of claim 14, wherein the moisture sensor includes another electrode and the one electrode of the moisture sensor having an exposed side that is exposed to a moist air mixture in the laundry receiving area of the laundry dryer, the moist air mixture occurring when laundry in the laundry receiving area is subjected to a drying operation that results in moisture initially retained by the laundry being released into surrounding air as the laundry is dried and the surrounding air increasing in its moisture content as a consequence thereof, the device being operable to apply a voltage to the another electrode and the one electrode that results in a current passing through laundry retained in the laundry receiving area, thereby permitting a voltage measurement proportional to a moisture content of the laundry, the device applying a voltage such that the exposed side of the one electrode can reach an evaporation enabling temperature sufficient to evaporate liquid in an air mixture in contact with the exposed side of the one electrode in the absence of a heat abatement measure, and the cooler operating to cool the one electrode such that the exposed side of the one electrode is substantially prevented from reaching the evaporation enabling temperature in spite of the application by the device of a voltage that would otherwise cause the exposed side of the one electrode to reach the evaporation enabling temperature.

22. The laundry dryer of claim 21, wherein the cooler includes an opening communicating with the laundry receiving area of the laundry dryer, and the cooler permits air to flow from outside the laundry receiving area into the interior of the one electrode to cool the one electrode and thereafter flow out of the one electrode via the opening into the laundry receiving area.

23. The laundry dryer as claimed in claim 14, further comprising a second electrode of the moisture sensor, wherein the electrodes form a voltage applying arrangement and this voltage applying arrangement is arranged on the laundry dryer relative to the laundry receiving area of the laundry dryer so that a voltage applied to the voltage applying arrangement results in a current passing through laundry retained in the laundry receiving area and the voltage of this current is measured at the voltage applying arrangement.

24. The laundry dryer as claimed in claim 23, wherein the respective one electrode whose heat is reduced by the cooler is exposed to an interior of the laundry receiving area of the laundry dryer to an extent that the respective one electrode is contacted by liquid entrained in a liquid-air mixture in the interior of the laundry receiving area of the laundry dryer and the cooler is operable to reduce the heat of the respective one electrode to a level at which the respective one electrode substantially avoids evaporating such entrained liquid.

25. A laundry dryer, comprising:

a laundry receiving area in which laundry to be dried is retained, laundry in the laundry receiving area being subjected to a drying operation whereby moisture initially retained by the laundry is released into surrounding air as the laundry is dried and the surrounding air increases in its moisture content; and a device for determining the conductance of laundry in the laundry receiving area, the device including a first electrode and an exposed side arrangement, the exposed side arrangement including a second electrode, the second electrode having an exposed side that is exposed to the laundry receiving area to an extent that the second electrode is contacted by a moist air mixture in the laundry receiving area, the device being operable to apply a voltage to the first electrode and the second electrode of the exposed side arrangement that results in a current passing through laundry retained in the laundry receiving area, thereby permitting a voltage measurement proportional to a moisture content of the laundry, the device applying a voltage in a manner such that the exposed side of the second electrode of the exposed side arrangement can reach an evaporation enabling temperature sufficient to evaporate liquid in the air mixture in contact with the exposed side in the absence of a heat abatement measure, and the exposed side arrangement operating to substantially prevent the exposed side of the second electrode from reaching the evaporation enabling temperature in spite of the application by the device of a voltage that would otherwise cause the exposed side of the second electrode to reach the evaporation enabling temperature.

* * * * *